United States Patent [19]

Nakazawa

[11] Patent Number: 4,629,674

[45] Date of Patent: Dec. 16, 1986

[54] ELECTROPHOTOGRAPHIC PROCESS INCLUDING CONTROLLING APPLIED CURRENT VALUES

[75] Inventor: Toru Nakazawa, Sennan, Japan

[73] Assignee: Mita Industrial Co., Ltd., Osaka, Japan

[21] Appl. No.: 625,536

[22] Filed: Jun. 28, 1984

[30] Foreign Application Priority Data

Jun. 30, 1983 [JP] Japan ..... 58-117092

[51] Int. Cl.[4] ..... G03G 13/16

[52] U.S. Cl. ..... 430/125; 430/126; 430/902

[58] Field of Search ..... 430/125, 902, 126

[56] References Cited

U.S. PATENT DOCUMENTS 3,813,242 5/1974 Ikeda et al. ..... 430/57
4,057,016 11/1977 Endo et al. ..... 430/49
4,265,998 5/1981 Barkley ..... 430/902

OTHER PUBLICATIONS

Japanese Laid-Open Patent Publication No. 16154/1981, Laid-Open Feb. 16, 1981 with partial English translation.

*Primary Examiner*—John L. Goodrow
*Attorney, Agent, or Firm*—Wenderoth, Lind & Ponack

[57] ABSTRACT

An electrophotographic process includes performing removal of electricity or pre-charging by direct current corona discharge and main charging by direct current corona discharge of a polarity reverse to the polarity for removal of electric charge or pre-charging on an organic photoconductive photosensitive layer chargeable at both the positive and negative polarities. Then is performed imagewise exposure, development with a toner and transfer of the toner image. Such operations are repeated to form plural images. Main charging is carried out with an applied current such that the photosensitive layer surface potential is saturated at 500 to 700 volts (absolute value) and removal of electric charge or pre-charging is carried out with at an applied current lower than the saturation injected current value and corresponding to 40 to 90% thereof.

5 Claims, 3 Drawing Figures

ELECTROPHOTOGRAPHIC PROCESS INCLUDING CONTROLLING APPLIED CURRENT VALUES

BACKGROUND OF THE INVENTION (1) Field of the Invention

The present invention relates to an electrophotographic process using an organic photoconductive photosensitive layer. More particularly, the present invention relates to an electrophotographic process in which the surface potential is always stable and hence images are stably formed.

(2) Description of the Prior Art

In a commercial electrophotographic copying machine, there is adopted a system in which at the start of the copying operation, electricity removal and cleaning of a photosensitive layer are first performed and operations of main charging, light exposure, development with a toner, transfer, electricity removal and cleaning are repeated a necessary number of times. Since the operations of electricity removal and cleaning are performed at the start of the copying operation to prevent poor copying resulting from contamination of the photosensitive layer during stoppage of the copying machine and the operations of electricity removal and cleaning again are performed at the termination of the copying operation, if an organic photoconductive photosensitive layer is used as a photosensitive material in an electrophotographic copying machine of this type, a certain disadvantage occurs. More specifically, there is observed a tendency that the image density of a print obtained in the first copying cycle is lower than that of a print obtained in the second or subsequent copying cycles. The reason for this undesirable phenomenon has not been clearly determined, but it is presumed that the reason will probably be that in the case of an organic photoconductive photosensitive layer, there is formed a carrier having a longer life than in the case of an inorganic photoconductive photosensitive layer, and since charging for removal of electricity is further performed on a photosensitive layer where removal of electricity has already been performed at the termination of the copying operation, influences of this charging for removal of electricity become prominent.

SUMMARY OF THE INVENTION

It is a primary object of the present invention to provide an electrophotographic process using an organic photoconductive photosensitive layer, in which the abovementioned defect is eliminated, a stable surface potential is always maintained in either the first cycle or the second and subsequent cycles and hence, images can always be formed stably.

More specifically, in accordance with the present invention, there is provided an electrophotographic process comprising performing removal of electricity or pre-charging by direct current corona discharge and main charging by direct current corona discharge of a polarity reverse to the polarity of direct current corona discharge for removal of electricity or precharging on an organic photoconductive photosensitive layer chargeable at both the positive and negative polarities, then performing imagewise exposure, development with a toner and transfer of the toner image, and repeating such operations to form images. The main charging is carried out with such an injected current that the photosensitive layer surface potential is saturated at 500 to 700 volts (absolute value), and removal of electricity is carried out with an injected current lower than the saturation injected current value and which corresponds to 40 to 90% of the injected current for main charging.

DETAILED DESCRIPTION OF THE INVENTION

The present invention will now be described in detail with reference to an embodiment illustrated in the accompanying drawings.

Figure 1:
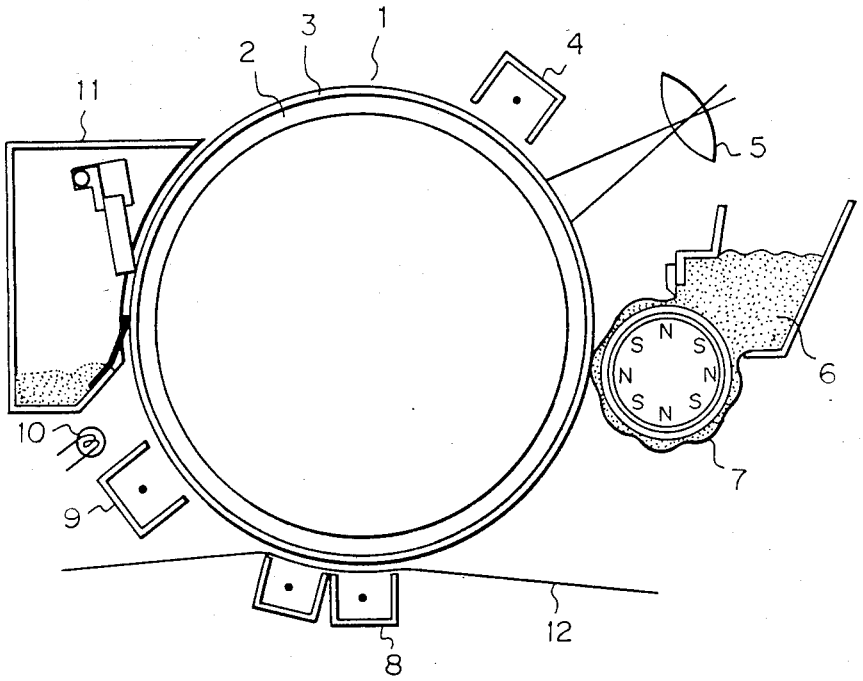
FIG. 1 is a schematic view illustrating an electrophotographic process.

Referring to FIG. 1 illustrating an apparatus for carrying out the electrophotographic process to which the present invention is directed, a photoconductive photosensitive layer 3 is formed on the surface of an electroconductive substrate 2 of a rotary drum 1. Along the surface of this drum 1, a direct current corona charger 4 for main charging, an optical system 5 for imagewise exposure, a developing mechanism 7 for retaining toner 6, a direct current corona charger 8 for image transfer, an electricity-removing direct current corona charger 9 of a polarity reverse to the polarity of the direct current corona charger 4, a light source 10 for removing residual charge and a toner-removing cleaning mechanism 11 are arranged in this order.

At the start of a reproduction operation; the electricity-removing charger 9, the light source 10 for removal of electricity and the toner-removing cleaning mechanism 11 are actuated to remove dust and solids adhering to the surface of the photosensitive layer 3.

Then, the photosensitive layer 3 is charged with a certain polarity by the main charger 4 and imagewise exposure is performed through the optical system 5 to form an electrostatic image corresponding to an original image. A toner image corresponding to the electrostatic image is formed on the photosensitive layer 3 by the developing mechanism 7 by use of the toner 6 charged with a polarity reverse to the polarity of the charge of the electrostatic iamge.

A transfer sheet 12 is supplied to the surface of the photosensitive layer 3 bearing the toner image thereon, and corona discharge of the same polarity as that of the electrostatic image is applied to the back surface of the transfer sheet 12 by the corona charger 8 for transfer, whereby the toner image is transferred onto the surface of the copying sheet 12. The transfer sheet 12 on which the toner image has been transferred is peeled from the photosensitive layer 3 and is fed to a fixing mechanism (not shown), in which the toner image is fixed and a print is obtained.

After the transfer of the toner image, there remains on the layer 3 a certain amount of residual toner determined by the transfer efficiency. Since the toner has passed through the transfer step, the toner particles are irregularly charged. In order to uniformalize the charge of the toner particles, direct current corona charging of a polarity reverse to the main charging is performed by the corona charger 9, and in order to remove the charge left in the photosensitive layer, the entire surface is exposed to light from the light source 10. In this state where the Coulomb force acting between the toner and photosensitive layer is weakened, the toner-removing cleaning operation is performed by the cleaning mechanism 11, and the foregoing operations of main charging through cleaning are repeated a number of times for obtaining a necessary number of prints. Thus, one reproduction process is completed. In the second and subsequent copying cycles, charging and subsequent operations are performed subsequently to the cleaning operation.

In the first copying cycle, before main charging, corona charging of a polarity reverse to the polarity of main charging is performed on the photosensitive layer in which removal of electricity and cleaning have already been performed. As pointed out hereinbefore, in the case of an organic photoconductive photosensitive layer, a carrier having a much longer life than in the case of an inorganic photoconductive photosensitive layer is readily formed by charging or by light exposure. Precharging of the first cycle to be conducted prior to main charging has influences on subsequent main charging, and it is found that the surface potential of the photosensitive layer at the time charging in the first cycle is considerably lower than the surface potential at the time of main charging in the second or subsequent cycles.

For example, in the case of a photosensitive layer composed of a dispersion of a perylene type charge-generating pigment in a polyvinyl carbazole type charge-transporting medium, the surface potential in the second and subsequent cycles is about 600 volts, while the surface potential in the first cycle is about 500 volts.

In the present invention, by performing main charging and removal of electricity with individual specific injected currents described in detail hereinafter, the surface potential in the first cycle can be increased to a level of the surface potential in the second and subsequent cycles and the surface potential thus is stabilized during all copying cycles, whereby stable images can always be obtained.

Figure 2:
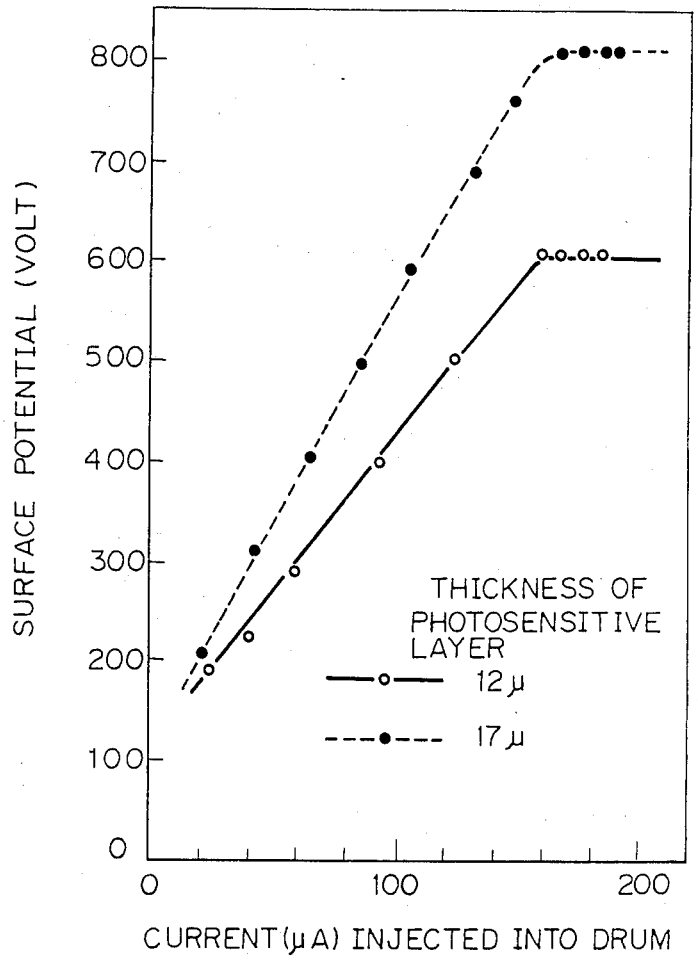
FIG. 2 is a diagram illustrating the relation between a current injected into a photosensitive drum and a surface potential of a photosensitive material.

In the present invention, main charging is carried out with such and injected current that the photosensitive layer surface potential is saturated at 500 to 700 volts (absolute value). In charging of an organic photoconductive photosensitive layer, there is ordinarily observed a tendency that the charging potential is proportionally increased with an increase of the thickness of the photosensitive layer. As shown in FIG. 2, if the injected current from the charger is increased, the surface potential (absolute value) of the photosensitive layer is substantially proportionally increased with the increase of the injected current during an initial stage, but the surface potential is not increased above a certain value and is saturated at such level even with a further increase of injected current value. This saturated surface potential depends on the thickness in photosensitive layers of the same type, whereby the smaller is the thickness the smaller is the saturated surface potential, and the larger is the thickness the larger is the saturated surface potential.

In the present invention, this saturated surface potential is set at 500 to 700 volts (absolute value) and main charging is carried out with an injected or applied current value corresponding to this saturated surface potential. The reason why the saturated surface potential is limited within the above-mentioned range is that if the saturated surface potential is too low and below the above range, an image having a sufficiently high density cannot be obtained. If the saturated surface potential is too high and exceeds the above range, in case of two-component type developer, at the development step, not only toner particles but also carrier particles adhere to an electrostatic image, and in case of a one-component type developer, an image having tailing is formed and the image quality is degraded. Furthermore, main charging is carried out with an injected current corresponding to the saturated surface potential, that is, a saturation injected current Is, whereby the surface potential of the photosensitive layer is always maintained stably within a certain range where development is accomplished appropriately, and reduction of the surface potential in the first cycle by removal of electricity or pre-charging can be prevented.

In the present invention, it also is very important that removal of electricity or pre-charging should be carried out with an injected current Ip which is lower than the saturation injected current Is and corresponds to 40 to 90% of the injected current for main charging. If the injected current Ip for removal of electricity or pre-charging is within the range of the saturation injected current Is, by influences of removal of electricity or pre-charging, the surface potential of the photosensitive layer by main charging is drastically reduced. This tendency is similarly observed when the injected current for removal of electricity or precharging exceeds 90% of the injected current for main charging. Since the injected current for removal of electricity or pre-charging is applied so as to remove the charges of toner particles, it may be considerably smaller than the injected current for main charging, but if the injected current for removal of electricity or pre-charging is smaller than 40% of the injected current for main charging, the object of removing the charges from the toner is not sufficiently attained.

The reason why the surface potential in the first cycle can be increased to a level substantially equal to the surface potential in the second and subsequent cycles in the present invention by performing main charging and removal of electricity or pre-charging under the above-mentioned injected current conditions has not clearly been determined. However, it is presumed that the reason will probably be that if main charging and removal of electricity or pre-charging are carried out under the above-mentioned injected current conditions, generation of a carrier having a relatively long life is controlled to a low level at the time of removal of electricity and even a carrier having a long life can be neutralized by main charging with the saturation injected current without substantial reduction of the surface potential.

In the present invention, it is difficult to directly measure the absolute value of the current injected into the photosensitive layer at the step of main charging or removal of electricity or pre-charging. However, it can easily be checked whether or not the injected current at main charging is the saturation injected current. For example, when an applied voltage to the charger is changed to change the electric current and the relation between this electric current and the surface potential of the photosensitive layer is examined, if the surface potential is substantially constant irrespectively of the change of the electric current, it is confirmed that main charging is carried out at the saturation injected current. Similarly, it can be confirmed that the injected current for removal of electricity or precharging is smaller than the saturation injected current.

The ratio of the injected current for removal of electricity or pre-charging to the injected current for main charging can easily be determined by locating a metal surface instead of the surface of the photosensitive layer, actually measuring the values of electric currents injected from the charger for main charging and the charger for removal of electricity or precharging and calculating the ratio of both the measured values.

The injected current of each charger can be set at an optional level by known means. For example, since the injected current is substantially proportional to the applied voltage of the charger, the injected current can be set at a desirable level by adjusting the applied voltage. Furthermore, since the injected current is decreased if the distance between the corona wire and the photosensitive layer is increased and the injected current is increased if this distance is decreased, the injected current can be adjusted by controlling this distance. Moreover, the injected current is decreased if the distance between the corona wire and the shield is decreased and the injected current is increased if this distance is increased. Therefore, the injected current can also be adjusted by controlling the distance between the corona wire and the shield.

All organic photoconductive photosensitive layers chargeable at both polarities can be used in the process of the present invention, but especially excellent effects can be obtained when an organic photosensitive layer comprising a layer of a dispersion of a charge-generating pigment in a charge-transporting medium, which is formed on an electroconductive substrate, is used. A photoconductive organic pigment such as a perylene type pigment, a quinacridone type pigment, a pyranthrone type pigment, a phthalocyanine type pigment, a disazo type pigment or a trisazo type pigment may be used as the charge-generating pigment, and a charge-transporting resin such as polyvinyl carbazole or a resin dispersion of a low-molecular-weight charge-transporting substance such as a hydrazone derivative or a pyrazoline type derivative may be used as the charge-transporting medium.

In the present invention, development can be accomplished by a magnetic brush developing method using a two-component type developer comprising an electroscopic toner and a magnetic carrier or a one-component type developer consisting of a magnetic toner. Of course, other developing means may be adopted.

Toner-removing and cleaning may be accomplished by mechanical means such as a fur brush or a blade when the Coulomb force between the toner and the photosensitive layer is weakened. Moreover, electromagnetic cleaning using a magnetic brush can be adopted when the toner is uniformly charged. In the latter case, the magnetic brush for development can also be used for cleaning, and one copying cycle is completed during two rotations of the photosensitive drum.

The present invention will now be described in detail with reference to the following example that by no means limits the scope of the invention.

EXAMPLE

(1) Preparation of Photosensitive Material

N,N'-Di(3,5-dimethylphenyl)-perylene-3,4,9,10-tetracarboxylic acid diimide: 1 part by weight
2,3-Dichloro-1,4-naphthoquinone: 2 parts by weight
Phenanthrene: 4 parts by weight
Tetrahydrofuran: 50 parts by weight The above components were charged in a stainless steel ball mill and dispersed and pulverized at 60 rpm for 12 hours to obtain a coating dispersion.

Then, 10 parts by weight of poly-N-vinyl carbazole (Luvican M-170 supplied by BASF AG), 1 part by weight of a polyester resin (Vylon 200 supplied by Toyobo K. K.) and 100 parts by weight of tetrahydrofuran were added to the dispersion, and the mixture was dispersed by the stainless steel ball mill at 60 rpm for 24 hours to obtain a homogeneous photosensitive dispersion.

An aluminum foil having a thickness of 60μ, on one surface of which a hard alumite treatment layer having a thickness of 5μ was formed, was prepared, and the photosensitive dispersion was coated on the alumite treatment layer surface of the aluminum foil by a blade coater. Then, heat treatment was carried out at 100° C. for 1 hour to obtain a photosensitive material comprising a photosensitive layer having a thickness of 12μ.

(2) Test of Photosensitive Material

The photosensitive material prepared in (1) above was attached to a PPC copying machine (Model DC-121 supplied by Mita Industrial Co., Ltd.) and was tested under the following conditions. Current Is injected into the photosensitive drum from the charger for main charging:

$$Is = 165\ \mu A \text{ (applied voltage} = +6.95 \text{ KV)}$$

Current Ip injected into the photosensitive drum from the charger for removal of electricity:

$$Ip = 78\ \mu A \text{ (applied voltage} = -5.10 \text{ KV)}$$

Injected current ratio:

$$(Ip/Is) \times 100 = 47.3\%$$

Incidentally, the developing zone was removed from the copying machine, and a probe of a surface potential meter was set at the position where a developer was brought into contact with the photosensitive drum to measure the surface potential of the photosensitive material. The obtained results are shown in Table 1 and FIG. 3, from which it will readily be understood that a stable surface potential can be obtained even in the first cycle.

When the developing mechanism removed was attached to the copying machine again and the copying test was carried out, a copy having a satisfactory image quality was obtained even in the first cycle without disturbance of the image, and there was found no substantial difference between this copy and a copy obtained in the 10th cycle.

COMPARATIVE EXAMPLE

A photosensitive material was prepared in the same manner as in the Example except that the thickness of the photosensitive layer was changed to 17μ in order to obtain a surface potential (500 to 700 volts) necessary for formation of images at an injected current.

The so-prepared comparative photosensitive material was attached to the same copying machine as used in the Example, and the test was carried out under the following conditions. Current Is injected into the photosensitive drum from the charger for main charging:

$Is = 81\ \mu A$ (applied voltage = 7.10 KV)

Current Ip injected into the photosensitive drum from the charger for removal of electricity:

$Ip = 78\ \mu A$ (applied voltage = −5.10 KV)

Injected current ratio:

$(Ip/Is) \times 100 = 96.3\%$

Figure 3:
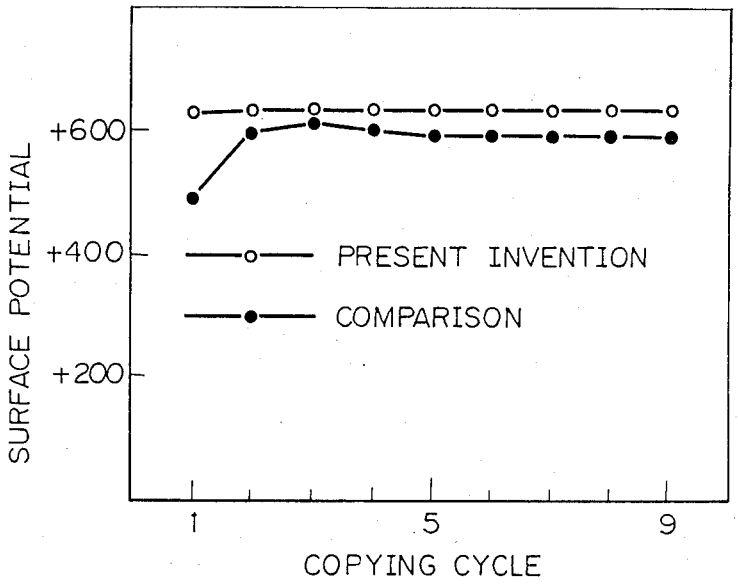
FIG. 3 is a diagram showing changes of the surface potential with respect to copying cycles.

When the surface potential of the photosensitive material was measured, as shown in Table 1 and FIG. 3, the surface potential in the first cycle was lower than the surface potential in the second and subsequent cycles, and a stable surface potential first was obtained only in the 5th cycle.

When the copying test was carried out in the same manner as in the Example, the image density of a copy obtained in the first cycle was lower than the image density of copies obtained in the second and subsequent cycles.

TABLE 1

| Copying Cycle No. | Surface Potential (V) | |
|---|---|---|
| | Present Invention (Example) | Comparison (Comparative Example) |
| 1 | 625 | 490 |
| 2 | 630 | 600 |
| 3 | 630 | 610 |
| 4 | 630 | 600 |
| 5 | 630 | 590 |
| 6 | 630 | 590 |
| 7 | 630 | 590 |
| 8 | 630 | 590 |
| 9 | 630 | 590 |

I claim:

1. In an electrophotographic process including providing an organic photoconductive photosensitive layer capable of being charged at both positive and negative polarities, performing a copying operation cycle by pre-charging said layer or removing electric charge therefrom by direct current corona discharge, main charging said layer by direct current corona discharge of a polarity opposite to that of said pre-charging, imagewise exposing the thus charged layer to form an electrostatic image, developing said electrostatic image with toner to form a toner image, transferring said toner image to a copy sheet, cleaning said layer to remove therefrom residual toner remaining after said transferring, and repeating said operations to provide a stable surface potential in the second and subsequent cycles of a copying operation, the improvement comprising:

conducting said main charging at a saturated applied current sufficient to maintain said layer at a surface potential saturated at an absolute value of 500 to 700 volts; and conducting said pre-charging or electric charge removal at an applied current which is 40 to 90% of said saturated applied current of said main charging.

2. The improvement claimed in claim 1, wherein said organic photoconductor photosensitive layer comprises an electrically conductive substrate and a layer of a dispersion of a charge-generating pigment in a charge-transporting medium formed on said substrate.

3. The improvement claimed in claim 2, wherein said charge-generating pigment is at least one member selected from the group consisting of perylene pigments, quinacridone pigments, pyranthrone pigments, phthalcyanine pigments, dis-azo pigments and tris-azo pigments.

4. The improvement claimed in claim 2, wherein said charge-transporting medium is a charge-transporting resin such as polyvinyl carbazole or a dispersion of a low-molecular-weight charge-transporting substance such as a hydrazone derivative or pyrazoline derivative in a resin.

5. The improvement claimed in claim 1, wherein said organic photoconductor photosensitive layer is a layer of a dispersion of N,N'-di(3,5-dimetylphenyl)perylene-3,4,9,10-tetracarboxylic acid imide as a charge-generating pigment in a charge-transporting medium composed mainly of polyvinyl carbazole.

* * * * *